United States Patent [19]

Whitlam et al.

[11] Patent Number: 4,550,541

[45] Date of Patent: Nov. 5, 1985

[54] SCAFFOLDING

[75] Inventors: Joseph E. Whitlam, Barnsley; Alwyn H. Richards, Pontefract, both of England

[73] Assignee: Stevecleave Limited, South Yorkshire, England

[21] Appl. No.: 634,190

[22] Filed: Jul. 26, 1984

Related U.S. Application Data

[63] Continuation of Ser. No. 442,907, Nov. 19, 1982, abandoned.

[30] Foreign Application Priority Data

Nov. 28, 1981 [GB] United Kingdom ..... 8136001

[51] Int. Cl.[4] ..... E04C 1/18

[52] U.S. Cl. ..... 52/309.8; 52/727; 182/46; 405/203; 405/204; 428/36; 428/71; 428/77; 428/319.1; 428/319.9

[58] Field of Search ..... 52/309.4, 309.7, 309.8, 52/309.9, 727; 114/45, 46, 48, 343; 182/46; 405/203, 204, 219; 441/69, 44; 428/36, 71, 77, 313.9, 319.1; 440/101; 416/74

[56] References Cited

U.S. PATENT DOCUMENTS

| | | | |
|---|---|---|---|
| 3,044,410 | 7/1969 | Edmundson | 416/74 |
| 3,531,578 | 9/1970 | Dey | 52/697 |
| 4,303,402 | 12/1981 | Gooding | 440/101 |

FOREIGN PATENT DOCUMENTS

| | | |
|---|---|---|
| 999922 | 7/1965 | United Kingdom . |
| 1165520 | 10/1969 | United Kingdom . |

*Primary Examiner*—George F. Lesmes
*Assistant Examiner*—P. R. Schwartz
*Attorney, Agent, or Firm*—Brooks & Kushman

[57] ABSTRACT

An aluminum scaffold tube filled with a predominantly closed-cell foam material selected so as to give the filled tube positive buoyancy in sea water and to resist collapse at pressures of up to at least 14062 $Kg/m^2$.

16 Claims, No Drawings

SCAFFOLDING

This application is a continuation of application Ser. No. 442,907, filed Nov. 19, 1982 now abandoned.

This invention relates to scaffolding.

The off-shore oil and gas industry is now well established on a large scale, and many off-shore installations are now in use. Maintenance and other operations on these installations very often involve the use of scaffolding, and hitherto it has been conventional practice to use standard metal scaffolding tubes and fittings. However, there is a major problem associated with the use of such materials.

No matter how careful scaffolders may be when working on scaffold structures it is inevitable that scaffolding tubes and fittings can be dropped or can accidentally be kicked or otherwise knocked off the scaffold during the erection or dismantling procedure. Furthermore, on off-shore installations there is the additional hazard of tubes and other materials being washed overboard. The requirement is imposed on the installation operators, often by law, that all materials washed overboard, or dropped from, an off-shore installation must be recovered from the sea bed. Needless to say this recovery of materials is extremely expensive and time-consuming, and it can also be a particularly hazardous operation for the diving personnel involved. Indeed, it is no exaggeration to say that the annual cost of recovering such materials runs into millions of dollars.

The dropping or washing overboard of scaffolding tubes, apart from the need for recovery, presents a further hazard. Any metal scaffolding tube dropped from the under-deck of an off-shore installation or from a slung scaffold directly below the under-deck will fall some eighty or more feed before entering the water. Accordingly, the tube has a high velocity on entering the water. It is found that after hitting the water the tube does not sink straight to the sea bed, but because of its shape and weight an action known as "jetting" occurs, whereby the tube accelerates through the water, often at a very shallow angle to the horizontal and following a zig-zag path. Such tubes travelling at high speed and often for considerable distances are extremely hazardous, and can easily maim or kill a diver who may be in the path of the tube and can also cause substantial and perhaps disastrous damage to any underwater structure or equipment that it may strike. In view of this, present safety requirements prohibit scaffolding on the outside areas of off-shore installations whilst divers are in the water, unless the divers are working close to the surface of the water and well away from the area being scaffolded. There is thus enforced down-time for either the divers or the scaffolders and this adds materially to the cost of a scaffolding operation.

These problems have long been recognised, but have been generally accepted by off-shore operators as a necessary expense and inconvenience. The present invention, although deceptively simple in concept, overcomes the problems and materially improves the safety and cost-effectiveness of scaffolding operations on off-shore installations. Indeed, both on the saving of life and saving of expense of advantages to be gained by the invention are quite exceptionally high.

According to the invention we provide a hollow tube, suitable for use in scaffolding, the tube having positive buoyancy in sea water.

This invention also extends to structures comprising an assembly of such hollow tubes, the structure having positive buoyancy in sea water. Examples of such structures are ladder beams and lattice beams composed of tubes that do themselves have positive buoyancy.

Thus, any such scaffolding tube or scaffolding structure that may fall from an off-shore installation will, at some time after impact with the water, float and can readily be recovered from the surface of the water. The danger arising from "jetting" of scaffolding tubes may be very substantially reduced, and even eliminated, and the recovery of floating articles is very much easier and cheaper than the recovery of sunken articles from the sea bed.

The invention is principally directed to scaffolding tubes, in view of the danger of "jetting" of a single tube dropped from an off-shore installation. In one embodiment the open ends of a scaffolding tube are capped in a waterproof manner to prevent ingress of water into the empty hollow interior of the tubes. The tube is thus air-filled and can, if the material and dimensions of the tube are suitable, exhibit positive buoyancy in sea water. In an alternative embodiment the external surface of a scaffolding tube has a layer of low density foam material secured thereto, for example by spraying a suitable foam onto the tube. Such a tube may also have its open ends capped.

In the most preferred embodiment of the invention, the interior of a scaffolding tube is filled with a low density foam material. By proper selection of the foam material in relation to the material and dimensions of the tube, the filled tube can readily be manufactured to have the required buoyancy.

Foam-filled scaffolding tubes are preferred as they afford much greater versatility of handling than do tubes which are provided simply with end caps or with an external foam layer. It is a frequent requirement that scaffolding tube be cut to required lengths on site, and this can readily be effected with foam-filled tubes merely by cutting through the foam as well as through the material of the tube. Both cut lengths are in themselves foam-filled and will exhibit the necessary buoyancy. If a capped tube were to be cut, then it would be necessary to cap the open cut ends of each of the two cut lengths. In certain circumstances, scaffolding tubes are required to have an open end fitted over a spigoted base plate. A tube having a capped end could not be so fitted, whereas a foam-filled tube can be fitted over a spigot with no problem, the spigot merely destroying or compressing some of the foam material in the end of tube. In other applications, scaffolding tubes may need to have small holes bored radially through the tube wall, and again this would be permitted by a foam-filled tube without affecting the buoyancy of the filled tube.

Preferably the tube used in the invention is a circular cross-section tube of extruded aluminium, having an outside diameter of from 4.7 to 5.08 cm (1.85 to 2 inches), a wall thickness of from 0.38 to 0.51 cm (0.15 to 0.2 inches) and a mean weight of metal in the tube of from 1.488 to 1.789 kg/m (1 to 1.12 lb/ft.) Particularly preferred are standared aluminium scaffolding tubes having an outside diameter of $4.83 \pm 0.050$ cm ($1.906 \pm 0.018$ inch), a wall thickness of $0.447 \pm 0.056$ cm ($0.176 \pm 0.022$ inch), and a mean weight of metal of $1.667 \pm 0.083$ kg/m ($1.12 \pm 0.056$ lbs./ft.). The tube should desirably have a tensile strength of not less than 284 kgf/mm$^2$ (18 tonf/inch$^2$) with an 0.1% proof stress of not less than 237 kgf/mm$^2$ (15 tonf/inch$^2$) as detailed in British Standard 1139:1964 "Specification For mental Scaffolding".

Poles dropped from an oil rig can reach depths in excess of 18 meters. Accordingly it is desirable that the foam should not collapse under the pressure experienced at such depths; if this were to happen then the tube could sink. Preferably, therefore, the foam used for filling the tube is capable of resisting collapse at pressures of up to 14062 $Kg/m^2$ (20 psi), more desirably of up to 18752 $Kg/m^2$ (26.67 psi). The foam desirably has a closed cell content of not less than 90%, in order to resist seepage of water in the foam. Open-cell foam material could be used, but unless it was used in conjunction with end caps the foam would become waterlogged and would only keep the tube afloat for a short length of time. However, the presence of the foam in the interior of the tube would prevent "jetting". Instead the tube would sink in a relatively slow and controlled manner to the sea bed. The foam desirably exhibits a water absorbency of not more than 0.025 $g/cm^2$ after immersion for one day at a pressure of 1218 $Kg/m^2$ and of not more than 0.035 $g/cm^2$ after immersion for four days at a pressure of 1218 $Kg/m^2$.

Preferably the foam that is used is self-bonding to the material of the tube and is substantially rigid in nature in order to have adequate resistance to the rough handling to which scaffolding tubes are often subjected. The foam material will preferably have a density of from 24.03 to 64.08 $Kg/m^3$ (1.5 to 4 $lbs/ft^3$), more preferably from 32.04 to 40.05 $Kg/m^3$ (2 to 2.5 $lbs/ft^3$). Three types of closed cell structure foam are considered especially suitable, these being polyurethane foams, polyisocyanurate foams and phenolic resin foams. The polyurethane foams are presently preferred, as in addition to allowing achievement of the required buoyancy they are very stable and have good resistance to most chemicals, including dilute acids and alkalis. Rigid polyurethane foam exhibits almost negligible water absorption and is thermally stable down to −200° C. It does not rot, is resistant to mould and decay, is odorless and presents no health hazard. It is also resistant to vibration and is a robust product that exhibits excellent resistance to the type of handling encountered in scaffold construction. Furthermore, it has very high thermal insulation properties which may improve the handling of metal tubes at low temperatures.

Preferably a tube according to the invention has a protective external coating applied to the material of the tube. Thus, the preferred aluminium tubes used in the invention can be either anodised and/or painted. This not only provides protection against corrosion, which is accelerated by the salt-laden atmosphere of the off-shore environment, but also reduces the risk of frictional sparking that may arise on accidental smearing of rusty steel by unprotected aluminium or aluminium alloy tubes. Painting of the tubes, desirably with a bright and possibly reflective coating, would serve a triple purpose. Floating tubes would more easily be seen in the water thereby aiding recovery, the paint would identify the tube as being an aluminium tube, so preventing an inadvertent inclusion in a steel scaffold and would also prevent unnoticed usage of the tubes in any areas thought to be hazardous due to the possibility of sparking.

To illustrate one specific embodiment of the invention 6.1 m (20 ft) lengths of seamless extruded aluminium scaffold tube were produced having an outside diameter of 4.84 cm, a wall thickness of 0.447 cm and a mean weight of 1.667 Kg/m. The tubes had a tensile stress in excess of 284 $kgf/mm^2$ with an 0.1% proof stress in excess of 237 $kgf/mm^2$. The tubes were filled with polyurethane isofoam RM 120 supplied by the Baxenden Chemical Co. Ltd. This is a fluorocarbon blown A4-D4-methylenediphenylisocyanate based room temperature curing rigid polyurethane foam system. Filling was effected by closing one end of the tube by a removable shutter and supporting the tube at an angle to the horizontal with the shuttered end being lowermost. The component chemicals of the foam were proportioned and mixed at controlled pressure and temperature. Whilst still fluid and reacting, a metered amount of foam was injected from a gun into the upper end of the tube. The combination of the injection pressure and of gravity caused the tube to be filled evenly with the expanding foam, with very little foam overspill. After cure, the shutter was removed. The rigid foam core cured in-situ in the tube exhibited excellent bonding to the internal aluminium face of the tube. The foam used had a free rise density of 33.64 $Kg/m^3$ and a core density of 38.45 $Kg/m^3$. Average foam density within the filled tubes was 34.12 $Kg/m^3$. The foam had a closed cell content in excess of 95%. Samples of the foam were immersed in fresh water at a four foot depth, representing a pressure of 1218 $Kg/m^2$, for one day and for four days. After one day the amount of water absorbed, measured by comparative weighing, was 0.024 $g/cm^2$ (0.05 $lbs/ft^2$) of exposed sample area, and after four days the amount of water absorbed was 0.034 $g/cm^2$ (0.07 $lbs/ft^2$). The foam material did not collapse at a pressure of 18752 $Kg/m^2$.

The filled tubes had a weight per unit length of 1.708 Kg/m. The volume of water displaced by a 30.48 cm (1 ft) length of foam-filled tube is 561 cc, which corresponds to a weight of sea water displaced on total submergence of the tube of 0.019 Kg/cm. Accordingly, the tubes exhibit positive buoyancy in sea water of 5.87 g/cm. This is sufficient to ensure that the tubes will float under all conditions. Indeed the tubes will float not only in sea water but also in fresh water where they will exhibit a positive buoyancy of 3.94 g/cm. The extruded tubes used had the ideal mean dimensions for extruded aluminium scaffold tubes. However, even adopting the worst possible values within the allowable tolerances on outside diameter, wall thickness and nominal weight, extruded aluminium scaffold tubes filled with polyurethane isofoam RM 120 at an average density of 34.12 $Kg/m^3$ would still exhibit positive buoyancy in sea water of 1.97 g/cm.

Scaffold tubes manufactured as in the foregoing example were subjected to tests by dropping the tubes from the platform of an off-shore oil rig in the North Sea. For each test miniature pressure transducers were fitted at each end of the tube in order to record the depth reached. The transducers used were those sold under the name National LX 1620 GB and were potted in epoxy resin into a polyvinylchloride housing secured to the end of the pole. Signals from the transducers were fed back to the surface by way of 3 mm diameter screened cable which also served as a tether to recover the tube. The signal from each pressure transducer was recorded to give a plot of depth versus time for each end of the pole. From this information, the maximum depth attained by the pole can be obtained and an estimate of the maximum horizontal distance travelled by the tube from the point of impact with the tube and the difference in depth of the two ends, the inclination of the tube from the vertical can be calculated from:

$$\theta = \cos - 1 \frac{\text{difference in length}}{\text{length of pole}}$$

For values of $\theta$ less than about 60° the velocity of the pole along its axis is very much greater than that perpendicular to its axis, so that horizontal distance penetrated during any time interval can be calculated from:

horizontal distance = vertical distance × tan $\theta$

This result, although not entirely accurate, is a close approximation and to obtain strict accuracy it is necessary to compensate for the effect of neglecting the velocity component perpendicular to the tube. The resultant correction factor that should be applied to the results can, in all cases, be shown to be less than 1, meaning that results obtained according to the simple formula given above will be conservative and will give an over-estimate of the actual horizontal distance travelled.

A series of tests was carried out in which 6.1 m long foam-filled tubes as aforesaid were dropped from different heights into the sea at various angles of inclination to the vertical. The results are given in Table I below, the drop heights being the height of the bottom of the tube at the point of release and the angle being the angle of the tube to the vertical. The penetration depth is the depth reached by the lowermost part of the pole and the horizontal penetration is calculated as aforesaid.

In addition to the approximations used in the calculations for horizontal penetration there are two other factors which could affect the accuracy of these experimental results in reflecting the true situation of a free scaffold tube falling from a platform. The first is the effect of the screened cable feeding the signals back from the transducers and the second the effect of the additional mass due to the instrumentation secured to the tube. The cable used in the tests was always at least twice the length of the anticipated maximum depth to which the tube would sink so that there would be no restraining effect on the tube due to tension in the cable. Accordingly, the only effective restraint that could be imposed by the cable would be skin friction on the cable as this travels with the pole through the water. Estimates indicated that this drag force was less than 5% of the total drag on the tube. The additional mass due to the instrumentation represented about 6% of the mass of the tube and decreased the nett buoyancy of the tube by about 3%. Thus, the effect of the instrumentation mass was to increase slightly the distance penetrated by the tube, to some extent offsetting the drag due to skin friction on the cable. Taking both factors into account, it would seem that, at the worst, the effect of the instrumentation is to introduce an uncertainty of 10% on the distance penetrated. Theoretical calculations on the behavior of the pole have confirmed that this factor is of the right magnitude.

TABLE I

| Test No. | Drop Height m | Penetration Depth m | Angle °to Vertical | Horizontal Penetration m |
|---|---|---|---|---|
| 1 | 9.14 | 8.93 | 27 | 4.54 |
| 2 | 9.14 | 11.98 | 0 | 0 |
| 3 | 9.14 | 8.38 | 39 | 6.71 |
| 4 | 12.19 | 7.89 | 47 | 8.63 |
| 5 | 16.154 | 13.37 | 15 | 3.54 |
| 6 | 16.15 | 12.19 | 21 | 4.69 |

TABLE I-continued

| Test No. | Drop Height m | Penetration Depth m | Angle °to Vertical | Horizontal Penetration m |
|---|---|---|---|---|
| 7 | 16.15 | 13.69 | 0 | 0 |
| 8 | 16.15 | 1.07 | 80 | * |
| 9 | 16.15 | 11.96 | 27 | 4.51 |
| 10 | 12.19 | 10.67 | 34 | 7.01 |
| 11 | 16.15 | 2.90 | 90 | * |
| 12 | 16.15 | 6.71 | 54 | 9.14 |
| 13 | 19.51 | 12.37 | 18 | 3.99 |
| 14 | 16.15 | 3.87 | 72 | 11.98 |
| 15 | 16.15 | 10.97 | 25 | 5.03 |
| 16 | 16.15 | 10.42 | 30.6 | 6.19 |
| 17 | 16.15 | 13.35 | 0 | 0 |
| 18 | 16.15 | 5.94 | 59.8 | 8.84 |
| 19 | 20.73 | 12.25 | 31 | 7.38 |
| 20 | 20.73 | 12.52 | 45 | 10.52 |
| 21 | 20.73 | 12.59 | 0 | 0 |
| 22 | 6.10 | 11.89 | 16.8 | 3.60 |
| 23 | 6.10 | 11.19 | 25 | 5.21 |
| 24 | 6.10 | 12.19 | 14.5 | 5.03 |
| 25 | 6.10 | 12.19 | 22.5 | 5.03 |

*horizontal penetration calculation no longer accurate.

The results given in Table I indicate that up to a drop height of approximately 20 m a pole 6.1 m in length will penetrate to a maximum depth of approximately 13.72 m and a maximum horizontal distance of approximately 12.19 m. Additionally, the effect of wave motion on tube behavior should be considered. It can be shown that with regard to vertical penetration the worst situation occurs when the tube strikes a long period wave in the wave trough. The effect of this situation is to increase the penetration depth by the value of the significant wave height. As far as horizontal movement is concerned if the tube breaks the water surface mid-way between the peak and trough of a wave then the horizontal travel can be increased by an amount that is, at most, equal to the significant wave height. These factors, together with the allowance of at least 10% of the experimental depth and horizontal penetration figures show that a zone can be defined beyond which a pole dropped from a given height will not travel. Accordingly working at depths below that zone or at horizontal distances from the rig outside that zone is safe. Such cannot be said for scaffolding using conventional tubes which, as already mentioned, sink and are also liable to travel horizontal distances through the water that can be many hundreds of meters.

It will be understood that the example given of filling foam into a tube is only one example of how this may be done. Injection of foam can be done manually or automatically on a production line basis by any suitable method, for example by use of a lance or a narrow high-pressure jet injecting the reacting foam into the tube. The foam may be accurately metered in any one of a number of ways to ensure that the correct quantity of foam is injected into the tube to cause filling of the tube at the correct foam density.

The polyurethane isofoam RM 120 referred to in the specific example in only one of many suitable polyurethane foams, other equivalent foams will be apparent to those skilled in the art. Polyisocyanurate foams are another group of predominantly closed cell foams that can successfully be used in the invention. Phenolic resin foams may alternatively be used. However, when phenolic resin foams are used there is a tendency for the foam materials to react with the exposed internal surface of the tube. Accordingly, before foam injection that internal surface should be coated with suitable primer matched to the phenolic resin foam being used to prevent acid attack by the foam of the tube material.

It will be understood that the foam-filled aluminium scaffold tube as described in any of its forms may be assembled into other scaffolding structures, such as ladder beams and lattice beams by assembling appropriate lengths of tube and joining these together by welding in any convenient manner. The resulting structures will also exhibit positive buoyancy in sea water.

We claim:

1. A scaffolding tube comprising: a hollow extruded aluminum tube of circular cross section with a uniform external diameter along the entire length thereof, the aluminum tube having an outer diameter in the range of about 4.70 to 5.08 cm, the aluminum tube also having a wall thickness in the range of about 0.38 to 0.51 cm and having a mean weight of aluminum in the range of about 1.488 to 1.789 Kg/m of the tube length, the interior of the aluminum tube being filled along the entire length thereof with a low density foam material to prevent jetting of the scaffolding tube when dropped into sea water, said foam material having a closed cell content of not less than about 90% to inhibit water from entering the scaffolding tube, and said foam material having a density selected to give the scaffolding tube positive buoyancy in sea water to eliminate the necessity of recovering the scaffolding tube from the sea bottom.

2. A scaffolding tube according to claim 1 and having a tensile strength of not less than about 284 $Kgf/mm^2$ and a 0.1% proof strength of not less than about 273 $Kgf/mm^2$.

3. A scaffolding tube according to claim 1 wherein the aluminum tube has an outside diameter of about $4.83 \pm 0.050$ cm.

4. A scaffolding tube according to claim 3, the aluminum tube having a wall thickness of about $0.477 \pm 0.056$ cm, and having a mean weight of aluminum in the scaffolding tube of about $1.667 \pm 0.083$ Kg/m.

5. A scaffolding tube according to claim 1 in which the foam material is capable of resisting collapse at pressures of up to about 14062 $Kg/m^2$.

6. A scaffolding tube according to claim 1 in which the foam material is capable of resisting collapse at pressures of up to about 18752 $Kg/m^2$.

7. A scaffolding tube according to claim 1 in which the foam material exhibits a water absorbency of not more than about 0.025 $g/m^2$ after immersion for one day at a pressure of about 1218 $Kg/m^2$ and of not more than about 0.035 $g/cm^2$ after immersion for four days at a pressure of about 1218 $Kg/m^2$.

8. A Scaffolding tube according to claim 1 in which the foam material has a density in the range of about 24.03 to 64.08 $Kg/m^3$.

9. A scaffolding tube according to claim 1 in which the foam material has an average density in the range of about 32.04 to 40.05 $Kg/cm^3$.

10. A scaffolding tube according to claim 1 in which the foam material is self-bonding to the aluminum interior of the tube.

11. A scaffolding tube according to claim 1 in which the foam material is polyurethane foam.

12. A scaffolding tube according to claim 1 in which the foam material is a polyisocyanurate foam.

13. A scaffolding tube according to claim 1 in which the foam material is a phenolic resin foam.

14. A scaffolding tube according to claim 1 and having a protective external coating applied to the aluminum of the tube.

15. A scaffolding tube according to claim 14 having an external surface painted with a bright-colored coating.

16. A scaffolding structure comprising: a plurality of scaffolding tubes, each scaffolding tube including an extruded aluminum tube of uniform size and shape along the entire length thereof, the interior of each aluminum tube being filled along the entire length thereof with a low density foam material to prevent jetting of the scaffolding tube when dropped into sea water, said foam material having a closed cell content of not less than about 90% to inhibit water from entering each scaffolding tube, said foam material having a density selected to give each scaffolding tube positive buoyancy in sea water to eliminate the necessity of recovering the scaffolding tube from the sea bottom, and detachable means that connects the scaffolding tubes to each other to form said scaffolding structure.

* * * * *